United States Patent [19]

Doan

[11] 4,255,990

[45] Mar. 17, 1981

[54] RATCHET-ACTION END WRENCH WITHOUT RATCHET

[76] Inventor: Obe O. Doan, 25577 Old Course Way, Valencia, Calif. 91355

[21] Appl. No.: 57,735

[22] Filed: Jul. 16, 1979

[51] Int. Cl.[3] ..... B25B 13/12

[52] U.S. Cl. ..... 81/179

[58] Field of Search ..... 81/129, 179

[56] References Cited

U.S. PATENT DOCUMENTS

| | | | |
|---|---|---|---|
| 2,907,243 | 10/1959 | MacLean | 81/179 |
| 3,023,654 | 3/1962 | Stambaugh et al. | 81/179 |
| 3,079,820 | 3/1963 | Vantchoura | 81/179 |

FOREIGN PATENT DOCUMENTS

| | | | |
|---|---|---|---|
| 101693 | 3/1941 | Sweden | 81/179 |

*Primary Examiner*—James G. Smith

*Attorney, Agent, or Firm*—Robert Louis Finkel

[57] ABSTRACT

This hand-operated, flat, open end wrench simulates the action of a ratchet wrench by causing the corners of a bolt head or nut to function analogously to the teeth of a ratchet. A single moving part, spring-loaded against or in close proximity to the bolt head or nut tangentially, aids in jamming or gripping the bolt head or nut and permits gripping a hexagonal head or nut either by opposite flats or by opposite vertices, whereby rotation in 1/12-turn increments is possible.

4 Claims, 6 Drawing Figures

FIG. 1
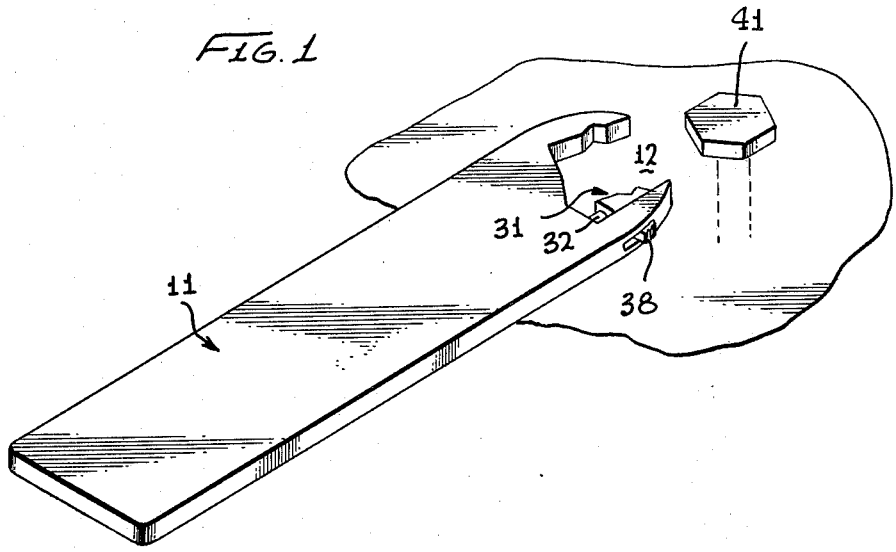
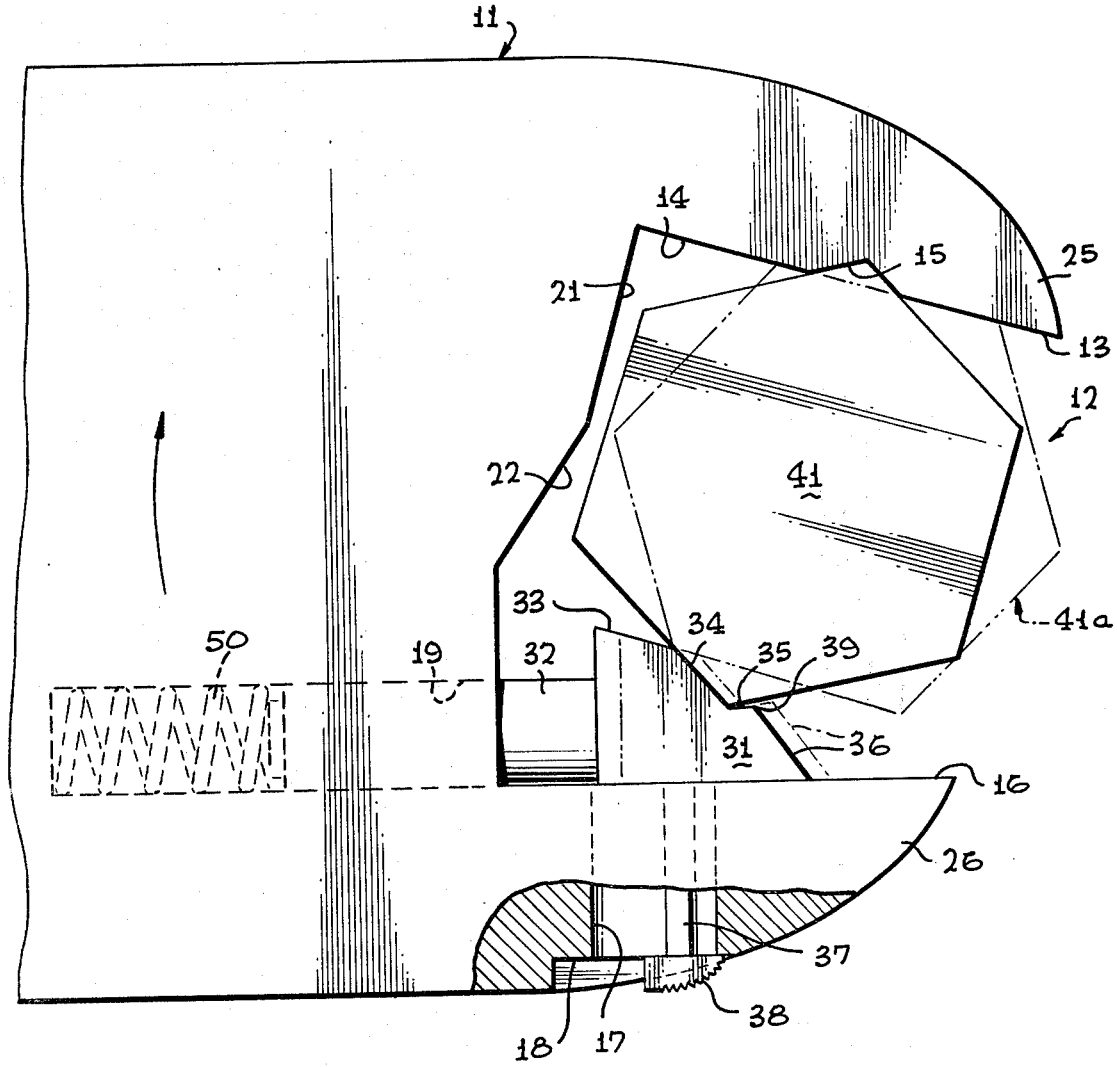
FIG. 2

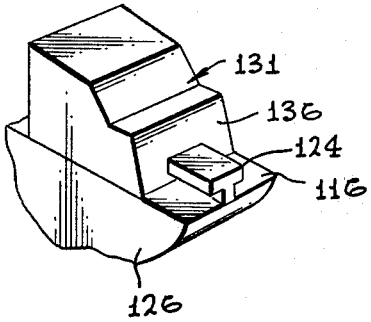
FIG. 6
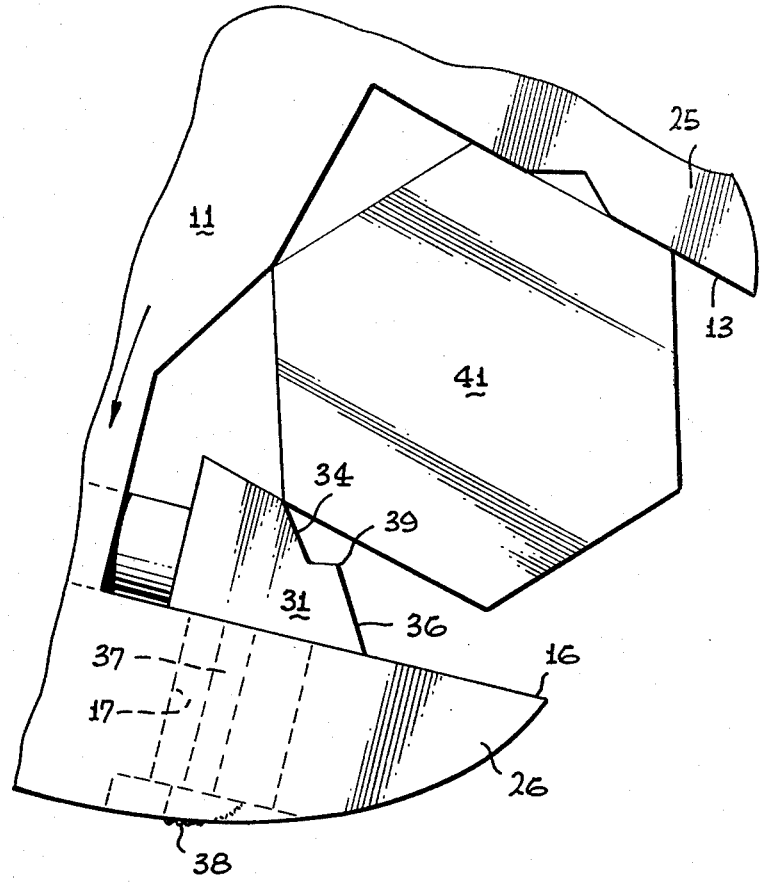
FIG. 3
FIG. 5
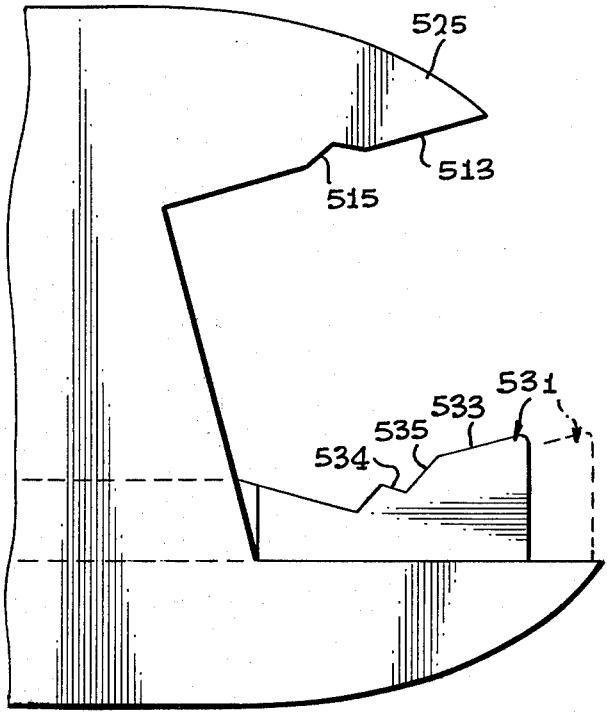
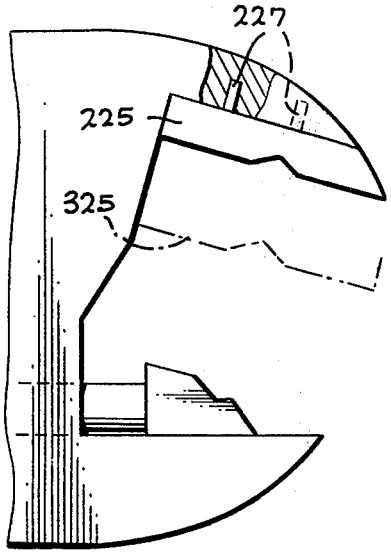
FIG. 4

RATCHET-ACTION END WRENCH WITHOUT RATCHET

BACKGROUND OF THE INVENTION

1. FIELD OF THE INVENTION

My invention is in the field of hand tools, and particularly relates to wrenches for gripping usually hexagonal nuts or bolt heads and rotating such nuts or heads. My invention is in a subcategory of this category of wrenches, whereby a bolt or nut can be tightened or loosened by a reciprocating motion of the wrenchhandle about the axis of the bolt or nut—whereby the user avoids problems of access or of limited space for manipulation, without the necessity of the wrench being repetitively removed from and replaced on the nut or bolt head.

2. PRIOR ART

Most wrenches in this subcategory are known as "ratchet wrenches." They make use of a ratchet and pawl, and of separate means for gripping the nut or bolt head. The gripping means may be on a common shaft with the ratchet, or indirectly driven from a shaft on which the ratchet is mounted; or in some cases may be at the center of the ratchet wheel itself, in which case the bolt to be driven, or the bolt on which the nut is being rotated, functions as the common shaft for the ratchet wheel and gripping means. In all of these configurations, however, the gripping means are separate from the ratchet wheel, giving rise to slight increases in bulk, which in occasional circumstances can be a considerable aggravation, and also giving rise to some additional mechanical complexity and cost.

Standard ratchet wrenches of the common-axis type include those familiarly called "socket wrenches"; these are quite expensive and often inconvenient or impossible to use when the clearance above a bolt head is too limited to accommodate the ratchet head and handle, or when a nut is to be rotated on a bolt further from the end of the bolt than the depth of the socket.

Most centerless ratchet wrenches, while designed to avoid or minimize the problems of the "socket" type, yet have these disadvantages:

1. they require some slight clearance above the bolt head for placement and removal of the wrench;
2. they cannot be placed (as can an ordinary end wrench) on a nut which is to be threaded onto a long length of pipe or tubing at a considerable distance from the ends of the pipe or tubing; and
3. they are relatively expensive to manufacture.

Certain special-purpose ratchet wrenches minimize or reduce the first two of these disadvantages, but at the expense of aggravating the third: in these wrenches, both the ratchet wheel and the gripping means are open-ended, and their open ends are capable of being brought into mutual alignment, so that they can be slipped over a pipe, for example, and then moved axially into engagement with a nut. These devices tend to be more elaborate and expensive than ordinary centerless ratchet wrenches. An example of wrenches in this category is the type covered by U.S. Pat. No. 2,954,715, issued Oct. 4, 1960 to C. E. Wycech.

With some very expensive open-end centerless ratchet wrenches it is even possible to move the open end directly onto a nut or bolt head, without any axial motion at all being necessary; these wrenches are generally power-driven, and designed for specialized use by professional craftsmen. Representative of these devices is that disclosed in U.S. Pat. No. 2,711,110, issued June 21, 1955 to A. J. Brame.

None of the devices of which I know provides a true ratchet action in an inexpensive open-ended wrench, such as would be suitable for hand operation by an occasional user.

One commercially available device permits rotating a bolt or nut by generally reciprocating motion of the wrench handle about the axis of the bolt or nut, without need for clearance axially, and at very low cost. This device is an end wrench without moving parts, one jaw of which is cut away to permit back-rotation of the wrench to reengage the bolt head or nut without completely removing the wrench from the head or nut. However, this wrench has the disadvantage that it must be back-swung more than a full one-sixth of a turn (that is, more than 60 degrees) to reengage a hexagonal bolt head or nut, whereas most standard ratchet wrenches reengage every 15 degrees or thereabouts.

Thus I know of no inexpensive open-ended wrench providing the equivalent of ratchet action with a backswing of less than 60 degrees. My invention is directing to supplying such a device.

BRIEF SUMMARY OF THE INVENTION

My invention contemplates a flat, open-ended wrench having a movable anvil which functions as one jaw and which by its motion and configuration permits gripping a nut or a bolt head either by its opposing flats or by its opposing vertices. The fixed jaw of the wrench has a flat face interrupted by a V-shaped notch, the angle of the V matching the angle of a standard head or nut vertex—that is, 120 degrees. The anvil likewise has a flat portion which is parallel to the flat face of the fixed jaw, and a notched portion positioned opposite the V-shaped notch in the flat face of the fixed jaw. The notched portion of the movable anvil is V-shaped, the angle of the V being slightly more than the angle of a standard head or nut vertex, to permit engagement of the nut vertex while keeping to a minimum the backswing of the wrench to reset the wrench on opposing flats of the head or nut. The anvil also has a beveled end face which is engaged and driven by a flat of the head or nut, to move the anvil out of gripping position into a retracted position during backswing.

The motion of the center of the anvil is substantially or generally tangential to the circle in which the nut or head shape is inscribed. Anvil motion in one direction increases the distance between the stationary jaw and the anvil to permit repositioning the wrench on the nut; and motion of the anvil in the opposite direction decreases that distance to provide for gripping the nut or bolt. The anvil is spring-loaded along its line of motion in such direction as to eliminate (or, in an alternative embodiment, to reduce) its clearance relative to the fixed jaw—and thus into engagement with the head or nut. On the backswing, the flat of the head or nut pushes the anvil out of gripping position, against the spring-loading; and after the backswing the spring-loading returns the anvil to gripping position. During and just after the backswing the anvil slides along one jaw, but the "working motion" (forward swing) applies force at such an angle that the anvil binds against that same jaw.

Because the ratchet action makes use of the vertices of the head or nut itself in place of a true ratchet, and so does not interpose a separate gripping device between the fixed opening of the wrench body and the head or nut, the wrench can be engaged with the head or nut directly (i.e., in a radial motion) without the necessity of any axial motion. Consequently no axial clearance above the head of a bolt is required; and a nut can be manipulated even at great distance from either end of the pipe or bolt on which it is being turned. Because the wrench grips either by opposing flats or by opposing vertices of the head or nut, the required backswing for re-engagement is only slightly more than one-twelfth turn, or 30 degrees. Finally, the mechanism is very economical in manufacture, having just one moving part, of inexpensive configuration, and an inexpensive spring.

The principles and features introduced above, and their advantages, may be more-fully understood from the detailed disclosure hereunder, with reference to the accompanying drawings.

BRIEF DESCRIPTION OF THE DRAWINGS

FIG. 1 is a general isometric drawing of a wrench made in accordance with my invention and constituting a preferred embodiment thereof. The drawing also shows in general relation (but not engaged) with the wrench a bolt head such as the wrench is adapted to engage.

FIG. 2 is an orthographic drawing of the head of the wrench of FIG. 1, shown partly cut away, with the head of a nut or bolt such as that of FIG. 1 shown engaged with the head of the wrench. Engagement in two different positions (by flats and by vertices, respectively) is illustrated. The anvil is shown in drive position.

FIG. 3 is a similar view of the head and the nut or bolt, but with the anvil in backswing position.

FIG. 4 is a similar view of the head but without the nut or bolt head, and illustrating optional interchangeable fixed jaws permitting use of the mechanism with different sizes of nuts or bolts.

FIG. 5 is a similar view of an alternate form of my invention.

FIG. 6 is an isometric view of a different form of anvil usable with the configuration of FIGS. 1 through 4.

DESCRIPTION OF PREFERRED EMBODIMENTS

As shown in FIG. 1 a wrench constructed in accordance with my invention, for use with a nut or a bolt head 41, consists of a flat extended body and handle 11 having an opening 12 adapted to grip such head 41 and also having movable within the opening 12 a shaped anvil 31. Connected with the anvil 31 is a release button 38.

As shown in FIG. 2 the body 11 has fixed jaws 25 and 26, the fixed jaw 25 having flat portions 13 and 14 adapted to engage flats on a nut or bolt head, and also having a notch 15 adapted to engage the corners or vertices of such nut or head 41.

The fixed jaw 26 has a flat face 16 adapted to accommodate sliding motion thereon of an anvil 31, whose motion is constrained by the sliding action of tongue 32 in hole 19 within the handle 11. The tongue and anvil are urged toward the open end of the wrench by spring 50 which bottoms in the hole 19. The cross-face 21 of the back of the opening 12 in the wrench acts as a stop so that the wrench is not engaged too far onto the nut or head 41, relative to the function of notches 15 and the anvil 31. The cross-face 21 is, however, cut away as at 22 to facilitate the backswing when the vertices are engaged. Specifically, the cutaway allows the first vertex clockwise (as drawn) from the anvil to move past the plane of face 21—which aids in the disengagement of that vertex from the notch 15. The anvil 31 is prevented from flying away from the wrench under influence of the spring 50 by a guiding and retaining pin 37 which slides in slot 17 within fixed jaw 26. The pin 37 has an additional function in connection of the anvil to an external control, the release button 38, which slides against recessed flat surface 18 and whose purpose is explained below.

The anvil is shaped with a flat surface 33 parallel to the flat face 13, 14 of fixed jaw 25. These opposing flat faces engage the opposing flats of nut or head 41, to permit driving the nut or bolt clockwise as suggested by the schematic arrow near the left end of the drawing.

The anvil is also shaped with a V-notch composed of flat surfaces 34 and 35. One flat surface 34 of the notch is parallel to one flat surface of the notch 15 in the fixed jaw 25, and the other flat surface 35 of the notch in the anvil 31 is nearly but not exactly parallel to the other flat surface of the notch 15 in the upper fixed jaw 25. The angle between the two surfaces 34 and 35 of the notch in the anvil is several degrees greater than the angle of the notch 15—such as, for example, 129 degrees instead of 120 degrees—to facilitate retraction of the anvil in operation. As shown in the full line 41, the nut or bolt head can be engaged at opposing vertices by the upper notch 15 in the fixed jaw 25 and the lower notch 34, 35 in the anvil 31.

When the nut or head 41 (or **41*a*) has been driven as far clockwise as possible or desired in a particular swing, the wrench can be reset by a counterclockwise backswing. If the nut, as at 41*a*, has been gripped by its flats, the anvil 31 is driven back (to the left, as drawn) against the action of loading spring 50, by, in some cases, action of a corner of the nut or head 41 against flat face 34 of anvil 31 (as shown in FIG. 3), followed by action of a flat of the nut or head against the corner 39 of the anvil, and finally against the beveled surface 36 of the anvil 31**.

If the nut or head, as at 41, has been gripped by its vertices the anvil 31 is driven back by action of the lower (as drawn) gripped vertex against the surface 34 of the anvil 31.

As there is some variation in dimensions among bolt heads and nuts of the same nominal size, and as gripping characteristics change with wear of the wrench surfaces, release button 38 is provided to permit disengagement of the wrench from the bolt head or nut in the event of binding.

In any case the anvil is partly retracted during the backswing, the wrench is disengaged from the nut or head, and moved back as far as possible or desired to reengage with a pair of flats or vertices of the nut or head for the next drive stroke. The amplitude of backswing may be as small as the angle required to move from a pair of opposed flats to the adjacent pair of opposed vertices—which, as previously noted, is only about 30 degrees.

To accommodate various sizes of nut or bolt head, as shown in FIG. 4 the fixed jaw 225 of the wrench may alternatively be made changeable, the interchangeable inserts such as 225 or the thicker one 325 being secured appropriately as by pins 227 engaged in matching holes in the wrench body.

An alternative form of my invention involves an anvil spring-loaded inward, rather than outward, and shaped as indicated in FIG. 5. Here the sliding motion when the anvil 531 moves toward the open end of the wrench diverges from the plane of flat face 513 of the fixed jaw, as contrasted with motion converging with the plane of flat face 13 in FIG. 2, when the anvil 31 moves toward the open end of the wrench in FIG. 2. The anvil 531 in this alternative form has its flat face 533 parallel to flat face 513, and the V-notch is at 534, 535.

FIG. 6 shows an alternative arrangement for stabilizing the anvil 131: a T-notch or groove cut in face 136 of the anvil 131 and extending through the anvil accommodates the tongue 124 of matching shape, upstanding from otherwise flat face 116 of the bottom jaw 126.

It will be understood that the foregoing disclosure is exemplary only, and not to be construed as limiting the scope of my invention, which scope is to be ascertained only by reference to the appended claims.

I claim:

1. An open end wrench, for use in rotating a nut or bolt head having a plurality of flats of which the adjacent flats intersect in vertices, comprising:

a body terminating in a pair of converging fixed jaws, a first one of said jaws having a first planar face for engaging any one of said flats, said first face being provided with a first notch for engaging a first one of said vertices;

a cross-face on the said body extending between said jaws and limiting the movement of said nut or bolt head within said jaws, a portion of said cross-face being cut away to provide a fulcrum for rotation of an adjacent one of said flats within said jaws;

an anvil reciprocably mounted to the second of said jaws for limited motion thereon and spaced from said first face to accommodate such nut or bolt head therebetween, said anvil defining a second planar face parallel to said first planar face, and also defining a second notch for engaging the vertex opposite said first vertex when said first vertex is in engagement with said first notch; and resilient means mounted between said anvil and said body, urging said anvil in the direction away from said body.

2. The wrench of claim 1, comprising:

a transverse slot through said second jaw;

a retaining pin mounted at one of its ends to said anvil and extending through said slot for lateral movement therein; and an enlarged manually operable release button mounted to the other end of said retaining pin for sliding, pin-retaining contact with said second jaw.

3. The wrench of claim 2, wherein the innermost face of said second notch is substantially parallel with the outermost face of said first notch, and the angle between the two faces of said second notch is greater than the angle between the two faces of said first notch.

4. The wrench of claim 3, comprising:

a recess formed in said first jaw; and a plurality of inserts adapted for releasable insertion into said recess, said inserts being of varying thickness, having a planar face for engaging said flats when said inserts are positioned in said recess, and having a notch in said planar face for engaging said vertices.

* * * * *